US010632490B2

(12) United States Patent
Jansen et al.

(10) Patent No.: US 10,632,490 B2
(45) Date of Patent: Apr. 28, 2020

(54) DEVICE FOR APPLYING A HOT-MELT TO A WEB OF MATERIAL

(71) Applicant: Maan Intellectual Properties B.V., Raalte (NL)

(72) Inventors: Andreas Willibrordus Maria Jansen, Wijhe (NL); Sjoerd Maria Jansen, Raalte (NL)

(73) Assignee: Maan Intellectual Properties B.V., Raalte (NL)

( * ) Notice: Subject to any disclaimer, the term of this patent is extended or adjusted under 35 U.S.C. 154(b) by 0 days.

(21) Appl. No.: 15/558,320

(22) PCT Filed: Mar. 16, 2016

(86) PCT No.: PCT/EP2016/055658

§ 371 (c)(1),
(2) Date: Sep. 14, 2017

(87) PCT Pub. No.: WO2016/146668

PCT Pub. Date: Sep. 22, 2016

(65) Prior Publication Data

US 2018/0056321 A1 Mar. 1, 2018

(30) Foreign Application Priority Data

Mar. 17, 2015 (EP) ..... 15159322

(51) Int. Cl.

| | |
|---|---|
| ***B05C 1/08*** | (2006.01) |
| ***B05D 1/28*** | (2006.01) |
| ***B05C 1/16*** | (2006.01) |
| *B05C 11/02* | (2006.01) |
| *B05C 5/02* | (2006.01) |

(52) U.S. Cl.

CPC ..... *B05C 1/0813* (2013.01); *B05C 1/0826* (2013.01); *B05C 1/0847* (2013.01); *B05C 1/165* (2013.01); *B05D 1/28* (2013.01); *B05C 5/0254* (2013.01); *B05C 11/025* (2013.01)

(58) Field of Classification Search

CPC ..... B05C 1/0813; B05C 1/0847

See application file for complete search history.

(56) References Cited

U.S. PATENT DOCUMENTS 3,818,860 A * 6/1974 Rebentisch ..... B05C 1/0813 100/306
3,991,708 A * 11/1976 Huebschmann ..... B05C 1/0813 118/202

(Continued)

FOREIGN PATENT DOCUMENTS

DE 202008000451 U1 3/2008
GB 1266745 3/1972

*Primary Examiner* — Karl Kurple
(74) *Attorney, Agent, or Firm* — The Webb Law Firm

(57) ABSTRACT

The invention relates to a device for applying a hot-melt to a web of material. The device includes a driven roller and a nozzle with a nozzle channel arranged adjacent the driven roller for supplying a hot melt through the nozzle channel to the surface of the roller. The invention also relates to a combination of a device according to the invention and a web of material, which web of material is guided along the driven roller and wherein the nozzle channel exits in front of the nip of the web of material and the driven roller.

15 Claims, 3 Drawing Sheets

(56) References Cited

U.S. PATENT DOCUMENTS 4,263,870 A * 4/1981 Saito ..... B05C 1/0813 118/258
4,518,637 A * 5/1985 Takeda ..... G03C 1/74 118/118
4,805,554 A * 2/1989 McIntyre ..... B05C 5/001 118/410
4,871,593 A 10/1989 McIntyre
4,948,635 A * 8/1990 Iwasaki ..... B05C 1/08 118/212
5,083,527 A * 1/1992 Naruse ..... B05C 3/125 118/119
5,308,659 A * 5/1994 Oyagi ..... C23C 2/006 118/259
5,633,045 A * 5/1997 Smith ..... B05C 1/0813 118/244
5,820,935 A * 10/1998 Kashiwabara ..... B05C 1/0826 427/359
6,815,008 B2 * 11/2004 Ichikawa ..... B05C 1/0826 118/118
7,025,830 B2 * 4/2006 Kanke ..... B05C 5/0254 118/680
7,041,339 B2 * 5/2006 Kanke ..... B05C 3/18 118/223
7,520,934 B2 * 4/2009 Nojo ..... B05C 1/0817 118/212
7,527,691 B2 * 5/2009 Ando ..... B05C 3/18 118/216
7,771,792 B2 * 8/2010 Yokoyama ..... C08J 7/06 427/336
9,225,004 B2 * 12/2015 Yamazaki ..... B05C 1/0808
10,005,925 B2 * 6/2018 Hyde ..... C09D 107/00
2003/0192473 A1 * 10/2003 Loukusa ..... B05C 5/0254 118/410
2004/0103992 A1 * 6/2004 Duwendag ..... B05C 1/0813 156/578
2004/0161531 A1 * 8/2004 Ferber ..... B65B 51/023 427/207.1

* cited by examiner

DEVICE FOR APPLYING A HOT-MELT TO A WEB OF MATERIAL

CROSS-REFERENCE TO RELATED APPLICATIONS

This application is the United States national phase of International Application No. PCT/EP2016/055658 filed Mar. 16, 2016, and claims priority to European Patent Application No. 15159322.5 filed Mar. 17, 2015, the disclosures of which are hereby incorporated in their entirety by reference.

BACKGROUND OF TITLE INVENTION

Field of the Invention

The invention relates to a device for applying a hot-melt to a web of material, which device comprises:

a driven roller;

a nozzle with a nozzle channel arranged adjacent the driven roller for supplying a hot melt through the nozzle channel to the surface of the roller.

Description of Related Art

Such a device is for example known from GB 1266745 or U.S. Pat. No. 3,818,860.

GB 1266745 discloses a driven roller along which a web of material is guided. An extrusion nozzle is furthermore provided and positioned close to the web, such that the web of material is arranged between the roller and the extrusion nozzle.

In order to achieve a thin and even film of extruded material, the space between the exit opening of the extrusion nozzle and the surface of the web of material needs to be small. This has the disadvantage that dirt particles and the like could get stuck between the nozzle and the web of material, such that tracks are caused in the resulting film of extruded material.

U.S. Pat. No. 3,818,860 discloses a driven roller along which a conveyor belt is arranged. Through a nozzle a fluid is deposited onto the conveyor belt and a blade smooths the fluid out to a preset thickness. The conveyor belt with the layer of fluid is transported further to a contact area, where a sheet of material is inserted into the nip of the roller and a counter object. At said nip, the fluid on the conveyor belt is transferred to the sheet of material.

However, due to the nip between the roller and the counter object, not all of the fluid will be transported with the same speed as the rotating speed of the roller through the nip. This will cause an accumulation of fluid, which adversely influences the resulting thickness and evenness of the film on the sheet of material.

Especially when long webs of material are provided with a layer of fluid, such as for example tapes with an adhesive layer, any small unevenness in the thickness will result in a substantial unevenness when the long web is rolled up. This is the result of the multiplication by each winding on the roll of the small unevenness.

SUMMARY OF THE INVENTION

It is an object of the invention to reduce or even remove the above mentioned disadvantages.

This object is achieved with a device for applying a hot-melt to a web of material which includes a driven roller;

and a nozzle with a nozzle channel arranged adjacent the driven roller for supplying a hot-melt through the nozzle channel to the surface of the roller. The nozzle channel is in flow direction, at least over a part of the circumference of the roller, parallel to the surface of the roller.

Because the nozzle channel is parallel to the surface of the roller, in flow direction, the direction of movement of the roller and the direction of the flow hot melt exiting the nozzle will be the same, contributing to a more even layer of hot melt on the roller.

Preferably the flow direction is tangential to the circumference of the roller.

In a preferred embodiment of the device according to the invention the nozzle channel is at least partially bounded by a part of the surface of the roller.

In this embodiment, the nozzle channel is partly formed by the surface of the roller. This has the advantage that the hot melt is already in contact with the surface of the roller, while it is still flowing within the nozzle channel. When the hot melt exits the nozzle it will be fully at the same speed as the roller and the flow direction will be the same as the direction of movement of the roller, which will result in a very smooth and even layer of hot-melt on the roller.

Another advantage of the feature that the nozzle channel is at least partially bounded by the surface of the roller, is that the thickness of the resulting layer of hot-melt can easily be controlled by controlling the rotation speed of the roller.

In a further preferred embodiment of the device according to the invention the nozzle channel is provided in transverse direction, perpendicular to the flow direction, at least one partition wall to apply the hot-melt in tracks to the web of material.

With the device according to the invention, the hot melt is applied in the desired thickness. There is no need to have an accumulation of hot melt at the nip. Now, by providing at least one partition wall, the hot melt can be applied in tracks, which are accurately defined and will not be disturbed by any accumulation, as would be with the devices according to the prior art.

Preferably, the at least one partition wall is provided by an elevation arranged in a nozzle channel wall. Typically, the nozzle channel will be formed by a metal body which is milled into the required shape. The elevations can easily be provided in the metal body.

In a still further preferred embodiment of the device according to the invention the elevation is virtually in contact with the opposite wall of the nozzle channel.

Preferably, the nozzle channel is bounded by a part of the surface of the roller, in flow direction, over at least a twentieth of the circumference of the roller. This provides for a sufficient long contact time between the hot-melt flowing through the channel and the roller.

Furthermore, it is preferred that the nozzle channel is in flow direction, over at least a tenth of the circumference of the roller, parallel to the roller.

The invention also relates to a combination of a device according to the invention and a web of material, wherein the web of material is guided along the driven roller and wherein the hot-melt exits the nozzle channel in front of the nip of the web of material and the driven roller.

By having the hot-melt exiting the nozzle in front of the nip, the layer of hot-melt on the roller can directly be transferred onto the web of material. Because it is not further necessary to control the thickness of the layer of hot-melt, any dirt particles trapped in the hot melt, will easily be transported along on the web of material, without causing any tracks or major disturbances.

Preferably, the distance between the t of the nozzle, where the fluid exits the nozzle and the nip of the web of material and the driven roller is less than 10 mm.

BRIEF DESCRIPTION OF THE DRAWINGS

These and other features of the invention will be elucidated in conjunction with the accompanying drawings.

DESCRIPTION OF THE INVENTION

Figure 1:
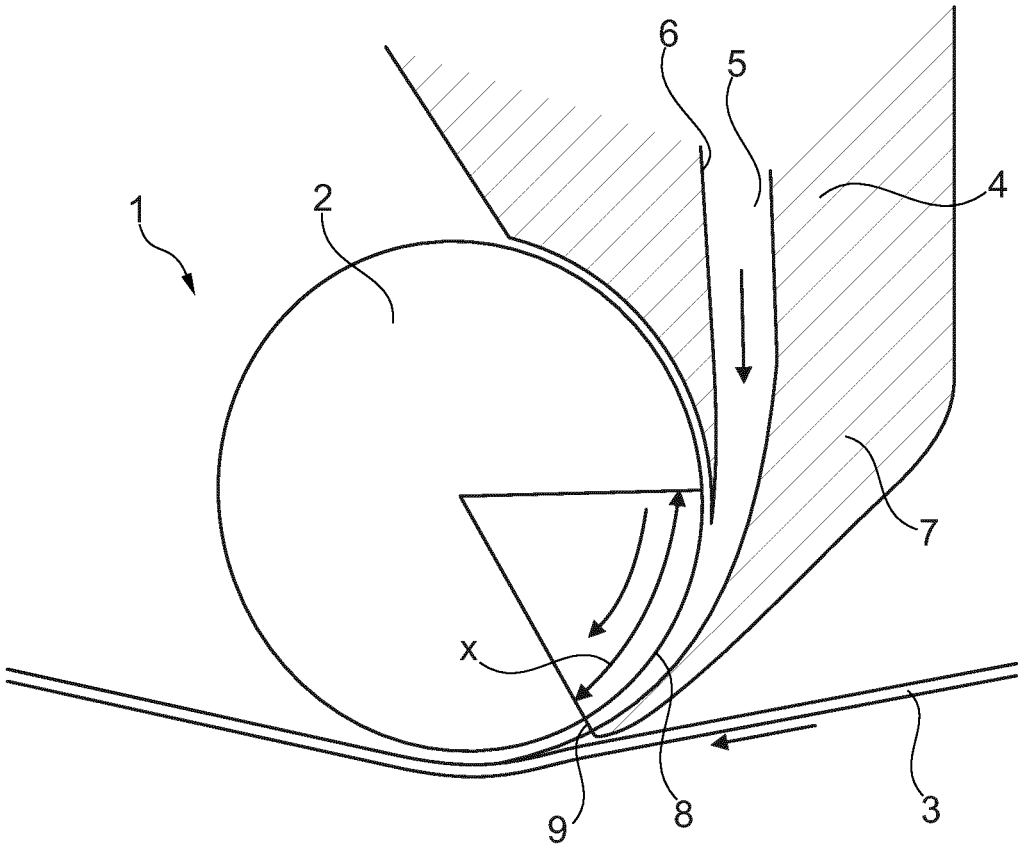
FIG. 1 shows a side view of an embodiment of the device according to the invention.

FIG. 1 shows a side view of an embodiment of the device 1 according to the invention. The device 1 has a driven roller 2 along which a web of material 3, such as a paper web, is guided. The driven roller 2 is in contact with the web of material 3.

Furthermore, a nozzle 4 is provided adjacent to the roller 2. The nozzle 4 has a nozzle channel 5 through which a fluid, such as a hot-melt, is supplied. The nozzle channel 5 has channel walls 6, 7. As the channel wall 6 is shorter than the channel wall 7, the nozzle channel 5 is also bounded by a part of the surface 8 of the roller 2 over a distance x of the circumference of the roller 2.

Figure 2:
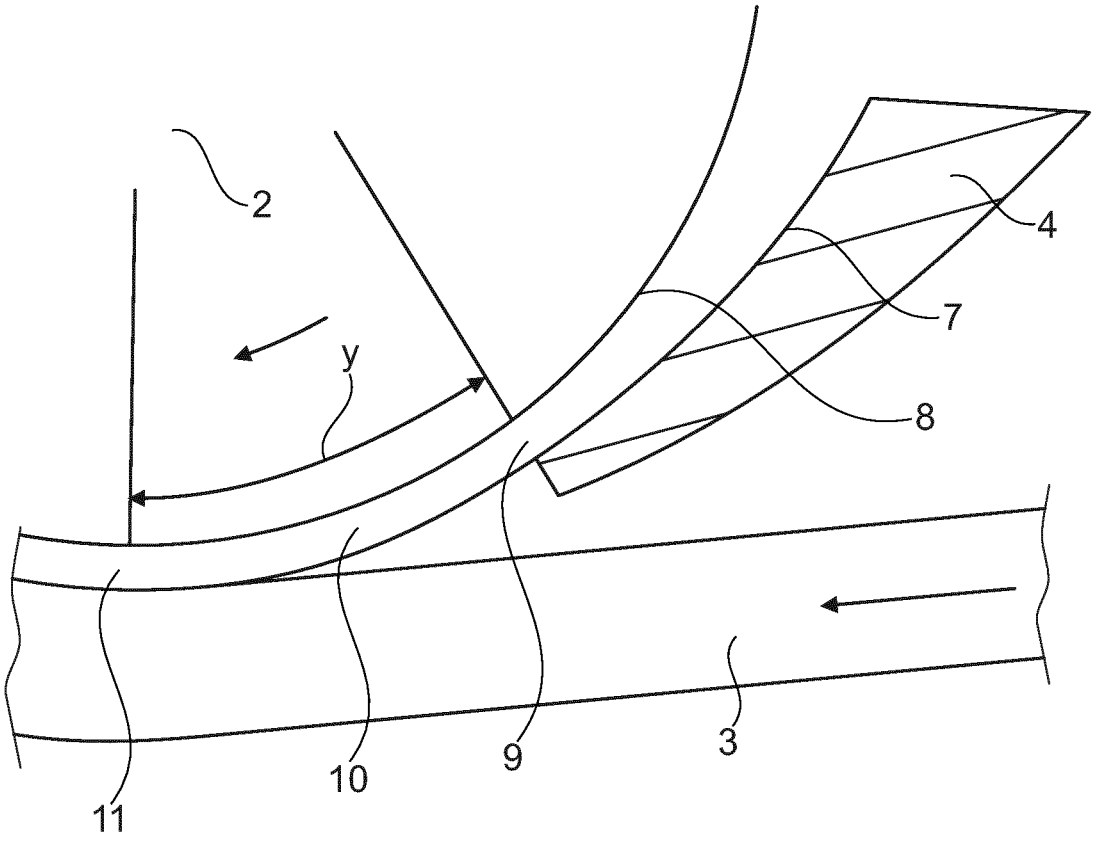
FIG. 2 shows an enlarged view of part of FIG. 1.

As can be seen in more detail in FIG. 2, the fluid exits at the tip 9, or channel, of the nozzle 4 between the driven roller 2 and the web of material 3 and provides a layer 10 of fluid directly on the surface of the roller 2. As the fluid was already in contact with the roller 2 over the distance x and because the channel 5 has been parallel to the surface of the roller, a very even and thin layer 10 of fluid can be provided. The nozzle 4 and the driven roller 2 outer surface form a layer 10 of hot-melt having a predetermined thickness at the nip of the roller which is then deposited to the web of material 3. Furthermore, as seen in FIG. 2, the web of material 3 at the nip moves in the same direction as the material moved by the driven roller 2.

Furthermore, when viewed in a direction perpendicular to the driven roller axis, the nozzle channel 5 is bounded by a first channel wall 6A, a second channel wall 6B being shorter than the first channel wall and part of the outer surface of the driven roller 2.

When the fluid layer 10 arrives at the nip 11 between the roller 2 and the web of material 3, the fluid layer 10 is transferred onto the web of material 3.

Preferably, the distance y between the tip 9 of the nozzle 4, where the fluid exits the nozzle 4, and the nip 11 is less than 10 mm. This ensures that the layer of fluid 10 is not disturbed between exiting the nozzle 4 and the nip 11, where the layer 10 is transferred onto the web of material 3.

Figure 3:
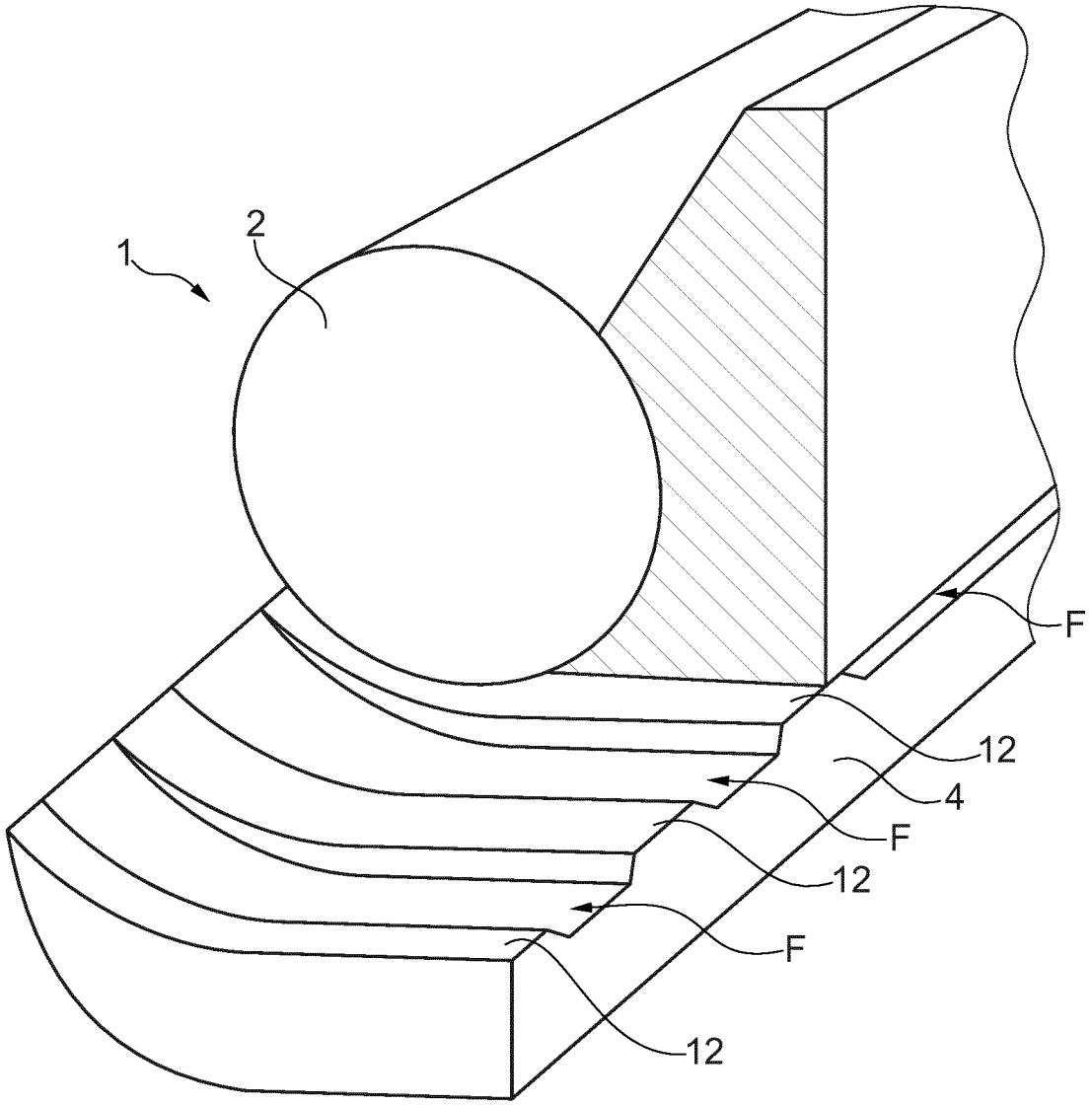
FIG. 3 shows a perspective view of the embodiment of FIG. 1.

FIG. 3 shows a perspective view of the embodiment 1 of FIG. 1. The nozzle channel 5 is provided in transverse direction, perpendicular to the flow direction F, with a number of elevations 12, which provide partition walls, such that tracks of hot-melt can be applied to the web of material 3.

The invention claimed is:

1. A device for applying a hot-melt to a web of material, wherein said device comprises: a driven roller for moving the web of material, wherein the driven roller has an outer surface and rotates in a first direction about a driven roller axis; a nozzle with a nozzle channel arranged adjacent the driven roller for supplying the hot-melt through the nozzle channel between the driven roller and the web of material directly to the surface of the driven roller, wherein the nozzle channel is bounded by a first channel wall, a second channel wall which is shorter than the first channel wall, and a part of the outer surface of the driven roller, wherein a portion of the nozzle channel is parallel to the outer surface of the driven roller from a point in the nozzle channel where the first channel wall extends past the second wall to a tip of the nozzle, and wherein the first channel wall directs the hot-melt against the outer surface of the driven roller in a flow direction that is a same direction the outer surface of the driven roller moves; and wherein the first channel wall of the nozzle and the driven roller outer surface form a layer of the hot-melt at a predetermined thickness which is then deposited to the web of material, the first channel wall extends from a point opposite the second wall to the tip of the nozzle where the hot-melt exits in front of a nip of the web of material and the driven roller, wherein at the tip of the nozzle the first channel wall is located directly between the driven roller and the web of material and the web of material at the nip moves in the same direction the outer surface of the driven roller.

2. The device according to claim 1, wherein the flow direction is tangential to the circumference of the driven roller.

3. The device according to claim 1, wherein the nozzle channel is bounded by the part of the outer surface of the driven roller, in the flow direction, over at least a twentieth of the circumference of the driven roller.

4. The device according to claim 1, wherein the nozzle channel is provided in transverse direction, perpendicular to the flow direction, at least one partition wall to apply the hot-melt in tracks to the web of material.

5. The device according to claim 4, wherein the at least one partition wall is provided by an elevation arranged in a nozzle channel wall.

6. The device according to claim 1, wherein the nozzle channel is in the flow direction, over at least a tenth of the circumference of the driven roller, parallel to the driven roller.

7. A combination of a device according to claim 1 and the web of material, wherein the web of material is guided along the driven roller and wherein the hot melt exits the nozzle channel in front of the nip of the web of material and the driven roller.

8. The combination according to claim 7, wherein the distance between the tip of the nozzle where the hot-melt exits the nozzle and the nip of the web of material and the driven roller is less than 10 mm.

9. The device according to claim 2, wherein the nozzle channel is bounded by the part of the outer surface of the driven roller, in the flow direction, over at least a twentieth of the circumference of the driven roller.

10. The device according to claim 1, wherein the nozzle channel is provided in a transverse direction, perpendicular to the flow direction, said nozzle channel having at least one partition wall to apply the hot-melt in tracks to the web of material.

11. The device according to claim 3, wherein the nozzle channel is provided in a transverse direction, perpendicular to the flow direction, said nozzle channel having at least one partition wall to apply the hot-melt in tracks to the web of material.

12. The device according to claim 2, wherein the nozzle channel is provided in a transverse direction, perpendicular to the flow direction, said nozzle channel having at least one partition wall to apply the hot-melt in tracks to the web of material.

13. The device according to claim 9, wherein the nozzle channel is provided in a transverse direction, perpendicular to the flow direction, said nozzle channel having at least one partition wall to apply the hot-melt in tracks to the web of material.

14. The device according to claim 1, further including the web of material.

15. The device according to claim 1, wherein the nozzle channel is provided in a transverse direction, perpendicular to the flow direction.

* * * * *